US006218994B1

(12) United States Patent
Mileski et al.

(10) Patent No.: US 6,218,994 B1
(45) Date of Patent: Apr. 17, 2001

(54) SMALL ANTENNAS FOR COMMUNICATION OVER SEA ICE

(75) Inventors: Paul M. Mileski, Mystic; Patrick E. Gilles, Pawcatuck; Brian L. Pease, Montville, all of CT (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 08/130,940

(22) Filed: Oct. 4, 1993

(51) Int. Cl.[7] ..... H01Q 1/04
(52) U.S. Cl. ..... 343/709; 343/719; 343/861
(58) Field of Search ..... 343/709, 719, 343/850, 861; H01Q 1/04, 1/34

(56) References Cited

U.S. PATENT DOCUMENTS 1,322,622 * 11/1919 Rogers et al. ..... 343/719
3,670,247 * 6/1972 Gutton et al. ..... 343/709
3,867,710 * 2/1975 Busignies ..... 343/709

FOREIGN PATENT DOCUMENTS

2140215 * 11/1984 (GB) ..... 343/719

* cited by examiner

*Primary Examiner*—Michael C. Wimer
(74) *Attorney, Agent, or Firm*—Michael J. McGowan; Prithvi C. Lall; Michael F. Oglo

(57) ABSTRACT

The invention described herein relates to an antenna system which makes use of the waveguide properties of sea ice. The antenna system broadly includes at least one antenna wire extending along and preferably in contact with a sea ice surface for transmitting and receiving substantially vertically polarized radio waves. In a first embodiment, the antenna system has a single antenna wire connected to a tuner at one end and grounded to seawater at a second end. The antenna system also has a second length of wire attached to the tuner. The second wire passes through a hole in the sea ice and is also grounded to the seawater beneath the sea ice. In an alternative embodiment, only the second wire is grounded to the seawater beneath the sea ice. The single antenna wire in this embodiment is ungrounded. In yet another embodiment, the antenna system comprises a dipole antenna wire laying on the surface of the sea ice and being connected to a radio for transmitting and receiving radio signals.

7 Claims, 2 Drawing Sheets

SMALL ANTENNAS FOR COMMUNICATION OVER SEA ICE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to an improved antenna system for enhancing the communication capabilities of individuals or vessels operating within high latitude regions covered with sea ice.

(2) Description of the Prior Art

Radio communication systems are old and well known in the art. These systems typically include a device for transmitting a radio frequency signal and for receiving a transmitted signal. Often, the environment in which the transmitter/receiver device and an associated antenna is located affects the ability to transmit or receive signals at particular frequencies. For example, in the Arctic, the reliability of high frequency signals, i.e., signals in the range of 2–30 MHz, is greatly diminished as a result of the high degree of solar activity concentrated within that region. This makes communications greater than 50 miles either difficult or impossible for extended periods.

Recognizing the environmental impact on the ability to receive or transmit signals, antenna systems have been developed that utilize the surrounding environment to enhance the communication system. U.S. Pat. No. 1,349,103 to Rogers illustrates one such system. Rogers discovered that grounded antennas are highly efficient when disposed horizontally or substantially parallel to the surface of the Earth, and surrounded by or enclosed in a uniform metallic screen but insulated therefrom. In one embodiment of his invention, Rogers illustrates two antennae extending substantially parallel to the Earth's surface in different directions from the signal instruments. Each of the antennae are enclosed in a metal screen or pipe. At its outer end, each antenna is connected to earth plates buried in the ground. Rogers states that the antennae may be positioned either above ground or below ground.

Rogers also notes that his invention is equally applicable to boats or vessels such as submarines. In FIG. 5 of the Rogers' patent, a shipboard antenna system is illustrated. In this system, the antennae are located in tubes or pipes mounted within the hull of the vessel. Each antenna is connected to a ground plate externally mounted to the vessel.

U.S. Pat. No. 4,839,661 to Losee illustrates yet another type of communication system which includes one or more substantially linear, electrically insulated radiating elements buried in the ground. The effective electrical length of each radiating element is equal to at least one-third of the wavelength of the electromagnetic signals being propagated. The efficiency of the system is increased, particularly when operating at high frequencies, by surrounding the radiating element(s) with a low loss dielectric substance such as crushed rock. The gain of the system is increased by forming an underground array comprising a plurality of radiating elements positioned substantially parallel to one another.

Neither of these patents however addresses the problems of communication systems in Arctic-type environments.

The present invention takes advantage of the discovery that sea ice provides a means for guiding radio waves at low attenuation in the 500 KHz frequency range. This low attenuation, along with the very low radio noise present in this region, makes this communication mode quite useful. The use of the 500 KHz maritime mobile frequency band for vessels at sea has been limited to large vessels or structures capable of supporting the large several hundred to one thousand foot wire lengths necessary for efficient utilization of this band. No antenna system has been available for this band for portable or emergency use specifically utilizing the waveguide properties of sea ice.

Accordingly, it is an object of the present invention to provide an antenna system which utilizes the waveguide properties of sea ice to transmit signals in the 500 KHz frequency range. It is a further object of the present invention to provide an antenna system that can be used in emergencies.

It is yet a further object of the present invention to provide an antenna system which is portable and does not require the use of long wire lengths or tail structures.

Still other objects and advantages of the present invention will become more apparent from the following description and drawings wherein like reference numerals depict like elements.

SUMMARY OF THE INVENTION

In accordance with the present invention, the foregoing objects are attained by the antenna system of the present invention which makes use of the waveguide properties of sea ice. The antenna system of the present invention broadly comprises at least one antenna wire extending along the surface of and in contact with the sea ice for transmitting and receiving substantially vertically polarized radio waves and radio means for receiving and/or transmitting a signal.

In a first embodiment, the antenna system comprises a single antenna wire connected to a tuner at one end. A second end of the antenna wire passes through a hole in the sea ice and is immersed in seawater. The antenna system also includes a second length of wire attached to the tuner. The second length of wire passes through a second hole in the ice where it contacts the seawater beneath the ice and acts as a ground.

In another embodiment, the antenna wire merely extends along the surface of the ice while only the second length of wire passes through a hole in the sea ice.

In still another embodiment, the antenna system comprises a dipole antenna wire laying on the surface of the sea ice.

Various features and details of the antenna system of the present invention are set out in the following description.

DETAILED DESCRIPTION OF THE PREFERRED EMBODIMENT

The present invention comprises an antenna system for efficiently transmitting and receiving radio waves over sea ice in the 500 KHz maritime mobile frequency allocation using relatively small lengths of antenna wire. More specifically, the present invention relates to an antenna system which exploits the electrical properties of sea ice so as to facilitate the transmission and reception of radio frequency (RF) energy.

Figure 1:
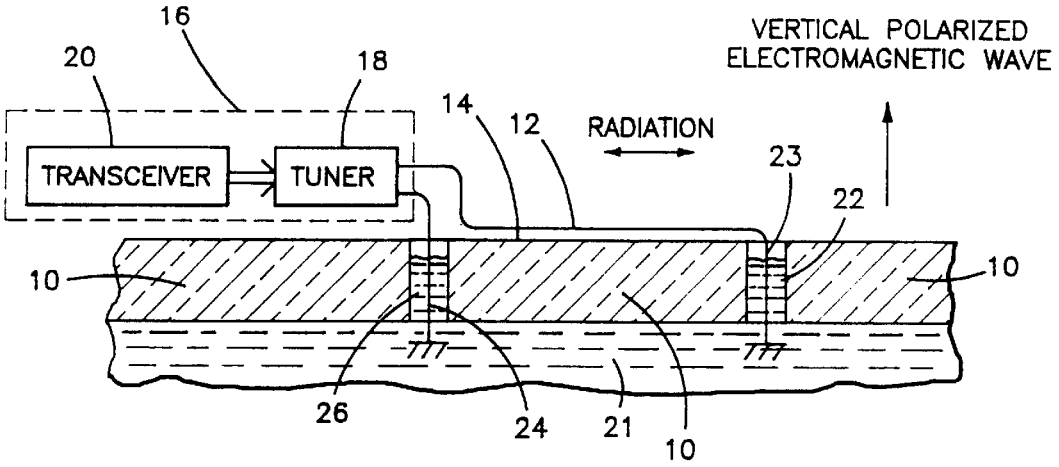
FIG. 1 is a schematic representation of an antenna system in accordance with a first embodiment of the present invention.

FIG. 1 illustrates a first embodiment of an antenna system in accordance with the present invention. As shown therein, the antenna system includes a horizontal wire 12 extending along and/or laying on a surface 14 of the sea ice 10. The wire 12 is connected at one end to a means 16 for receiving and/or transmitting radio wave signals. At its opposite end, the wire 12 is connected to the seawater 21 by means of a substantially vertically extending end portion 23 passing through a first hole 22 in the ice 10.

Figure 2:
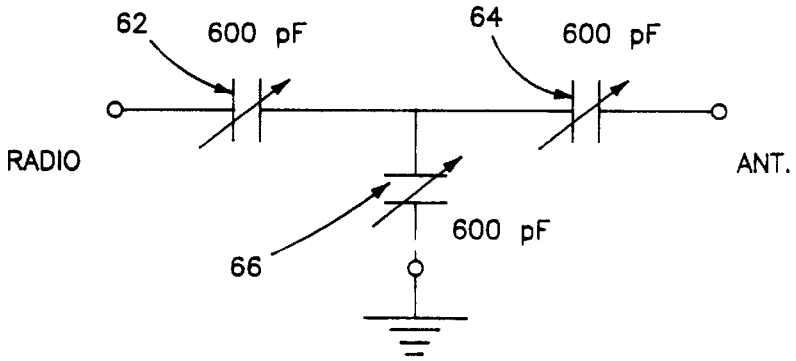
FIG. 2 is a schematic representation of a tuner which can be employed in the antenna systems of the present invention.

The receiving and transmitting means 16 may comprise any suitable radio transmitter/receiver known in the art. For example, the receiving and transmitting means may comprise a tuner 18 and a transceiver 20. As shown in FIG. 2, the tuner 18 may comprise a series of 600 pF capacitors 62, 64, and 66. Such a tuner may be used because the grounded wire 12 has an impedance which is inductive. Alternatively, the tuner 18 may comprise any other suitable tuner known in the art. As shown in FIG. 1, the tuner 18 is preferably grounded by a substantially vertically extending wire 24 passing through a second hole 26 in the ice 10 and which is in contact with the seawater 21 beneath the ice.

It has been found that the combination of the horizontal on-ice portion of the wire 12 and the through water conduction path results in a loop antenna which radiates its greatest energy in close proximity to the ice in the direction of the plane of the loop. Thus, the use of this seawater grounded wire, fed against seawater at its ungrounded end, results in the transmission or reception of substantially vertically polarized radio or electromagnetic waves which are closely coupled to the surface 14 of the sea ice and which can travel relatively great distances with relatively low attenuation.

It has also been found that the antenna system of FIG. 1 can operate effectively with an antenna wire 12 having a length as short as about 20 feet. While length is otherwise not critical, the longer the wire 12, the better.

The principal advantage of the antenna system of the present invention is that long wire lengths and tall structures are not necessary for use. As a result, the antenna system is useful as a fast, easily deployed on ice emergency communication system or as a beacon antenna for an ice camp, ship or aircraft. The invention is further useful in that the sea ice guided mode of signal propagation is not susceptible to fading or distortion as is a HF signal and propagates to much greater distances than does VHF signals.

Figure 3A:
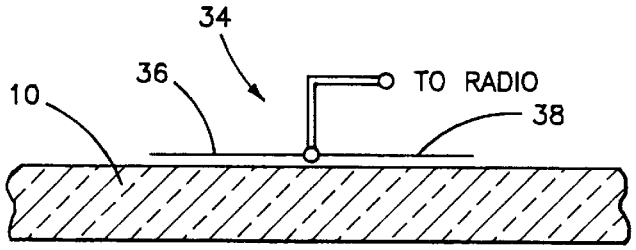
FIG. 3A is a schematic representation of an alternative embodiment of an antenna system in accordance with the present invention.
Figure 3B:
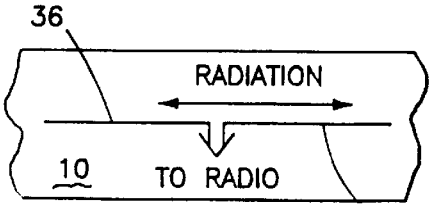
FIG. 3B is a top view of the antenna system of FIG. 3A.
Figure 4:
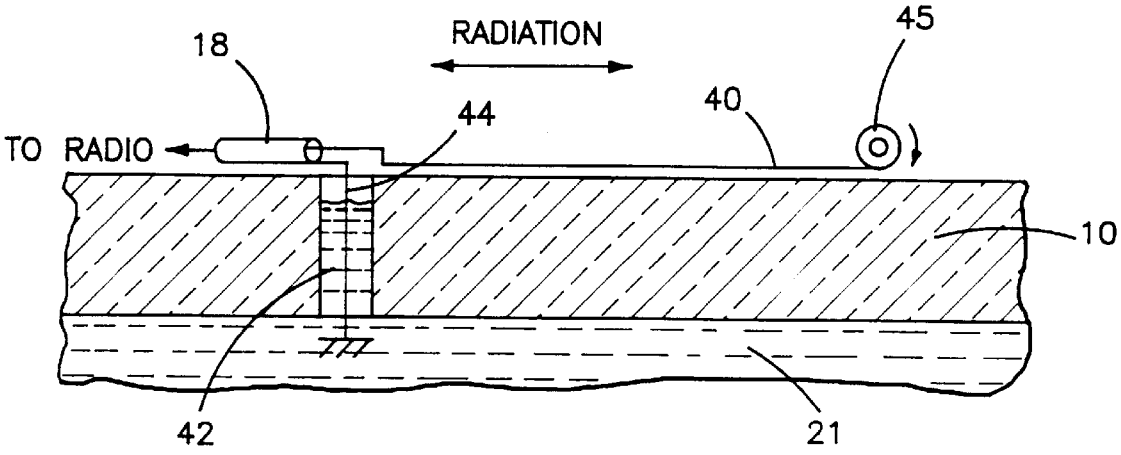
FIG. 4 is a schematic representation of yet another embodiment of an antenna system in accordance with the present invention.
Figure 5:
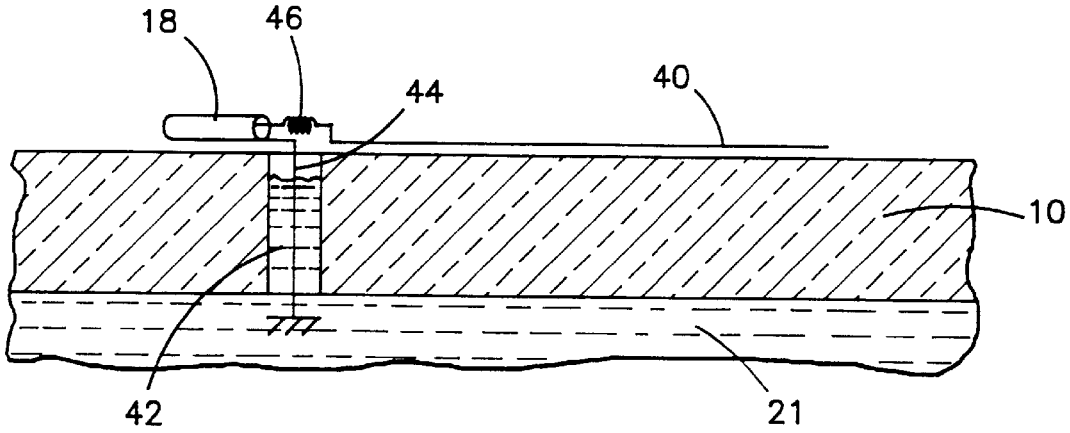
FIG. 5 is a schematic representation of still another embodiment of an antenna system in accordance with the present invention.

FIGS. 3 through 5 show several alternatives to the system of FIG. 1. As shown in FIG. 3A, the antenna may be a dipole antenna 34 formed by two wires 36 and 38 extending along the surface 14 of the ice in opposite directions. The principal advantage to this embodiment is that no ice holes are required. To be effective however, the length of each wire 36 and 38 must be approximately 330 feet. While dipole antennas are known in the art, the antenna system of FIG. 3A takes advantage of an enhanced mode of propagation not utilized by any known communication system. The antenna system of FIG. 3 launches or radiates a substantially vertically polarized wave in the direction of the wires 36 and 38 as shown in FIG. 3B. In other words, the maximum energy is radiated or received in the direction of the on ice dipole antenna.

In another embodiment, the antenna may be formed by a single ungrounded wire 40 fed against water via a single ice hole 42. As before, the wire 40 is attached at one end to a tuner 18 which is grounded to seawater by a wire 44 passing through the hole 42. The wire 40 lies substantially horizontally on the surface 14 of the sea ice. The second end of the wire is connected to a reel 45 for winding and unwinding the antenna wire. It has been found that to be effective the wire 40 should have a length of approximately 330 feet.

While specific illustrative lengths for the dipole antenna wires and the single ungrounded wire have been set out above, it should be recognized that the optimal length for the wires in each of these embodiments will vary somewhat as a function of ice thickness and age. Appropriate lengths can be determined by the observation of reflected RF power upon transmission, and the lengths "reeled out" until minimum reflected power is observed.

Another advantage to the use of either the dipole or the ungrounded single wire is that neither requires the use of additional circuitry for the purpose of tuning the antenna to match a 50 ohm transmission line if the lengths are chosen properly. If necessary, the physical length of either of these ungrounded antennas may be reduced substantially by the use of a series inductor at the feedpoint. FIG. 5 illustrates the use of such an inductor 46 in a single ungrounded wire type system such as that shown in FIG. 4.

It is apparent that there has been provided in accordance with this invention small antennas for communication over sea ice which fully satisfy the objects, means and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A system for receiving and transmitting radio signals in high latitude regions where the environment includes sea ice having a first hole therein, said system comprising:

an antenna for transmitting and receiving substantially vertically polarized radio waves, said antenna being formed from an antenna wire having a first end and a second end;

tuning means for tuning a signal being transmitted by or being received by said antenna and said first end of said antenna wire being connected to said tuning means and said second end of said antenna wire passing through said first hole and contacting seawater beneath said sea ice; and said antenna being deployed on and extending along an upper surface of said sea ice.

2. The system of claim 1 further comprising:

a ground wire attached to said tuning means; and said ground wire passing through a second hole in said sea ice and being in contact with said sea water, whereby said antenna wire, said ground wire and said sea water define a conduction path which results in a loop antenna that radiates its greatest energy in close proximity to said sea ice in the direction of a plane defined by said antenna wire, said ground wire and said sea water.

3. The system of claim 2 further comprising a transceiver connected to said tuning means.

4. The system of claim 3 wherein said antenna wire has a minimum length of about 20 feet.

5. A system for receiving and transmitting radio signals in high latitude regions where the environment includes sea ice, said system comprising:

an antenna for transmitting and receiving substantially vertically polarized radio waves, said antenna being formed from a wire; and said antenna being deployed on and extending along an upper surface of said sea ice;

wherein said antenna wire is ungrounded and the system further comprises:

means for generating and receiving a tuned radio wave signal;

said generating and receiving means comprising a radio and a tuner; and said tuner being grounded to seawater by a ground wire passing through a hole in said sea ice.

6. The system of claim 5 further comprising:

an inductor connected to a first end of said antenna wire.

7. A system for use in a sea ice environment on a surface of said ice for receiving and transmitting radio waves, said system comprising:

a transceiver for transmitting and receiving radio waves;

a tuner connected to said transceiver, said tuner being grounded to seawater by a ground wire passing through a first hole in said sea ice surface;

a grounded antenna wire connected to said tuner, said grounded antenna wire deployed upon, extending along and being in contact with said sea ice surface; and said antenna wire being grounded to said seawater by a vertically extending portion thereof passing through a second hole in said sea ice surface.

* * * * *